United States Patent [19]

Jaeschke

[11] 4,315,569

[45] Feb. 16, 1982

[54] REPLACEMENT WHEEL DISPLAY CARTON

[75] Inventor: Harold R. Jaeschke, Milwaukee, Wis.

[73] Assignee: Champion International Corporation, Stamford, Conn.

[21] Appl. No.: 167,994

[22] Filed: Jul. 14, 1980

[51] Int. Cl.[3] ..... B65D 25/54; B65D 85/06

[52] U.S. Cl. ..... 206/45.31; 206/304; 206/491; 206/806; 229/39 R

[58] Field of Search ..... 206/304, 491, 45.31, 206/45.14, 806; 229/38, 39 R

[56] References Cited

U.S. PATENT DOCUMENTS

| | | | |
|---|---|---|---|
| 1,141,489 | 6/1915 | Richardson | 229/39 R |
| 1,927,667 | 9/1933 | Miller | 206/0.82 |
| 2,017,405 | 10/1935 | Pantalone | 229/39 R |
| 2,331,754 | 10/1943 | Wohlers | 229/39 R |
| 2,807,404 | 9/1957 | Cote | 229/39 R |
| 2,979,192 | 4/1961 | Blonder | 229/39 R |

*Primary Examiner*—William T. Dixson, Jr.
*Attorney, Agent, or Firm*—Evelyn M. Sommer

[57] ABSTRACT

A display carton for a replacement wheel assembly of the type used on a lawn mower, wheelbarrow, spreader, or other garden-type vehicle. The carton is provided with opposed sidewall panels which contain cutouts so that the wheel assembly protrudes beyond the carton sides enabling a purchaser to view the wheel tire prior to selecting the wheel assembly for purchase. Each sidewall panel has a tuck end panel inserted into the carton and secured in place by a tuck lock flap pivotably connected to the rear wall panel of the carton. The tuck lock flap includes a plurality of creases intermediate its edges so that it can be folded and positioned between the wheel assembly and a tuck end panel within the carton adjacent to the rear wall panel of the carton, between the rear wall panel and the wheel assembly, to preclude opening of the carton and removal of the wheel assembly on display.

13 Claims, 9 Drawing Figures

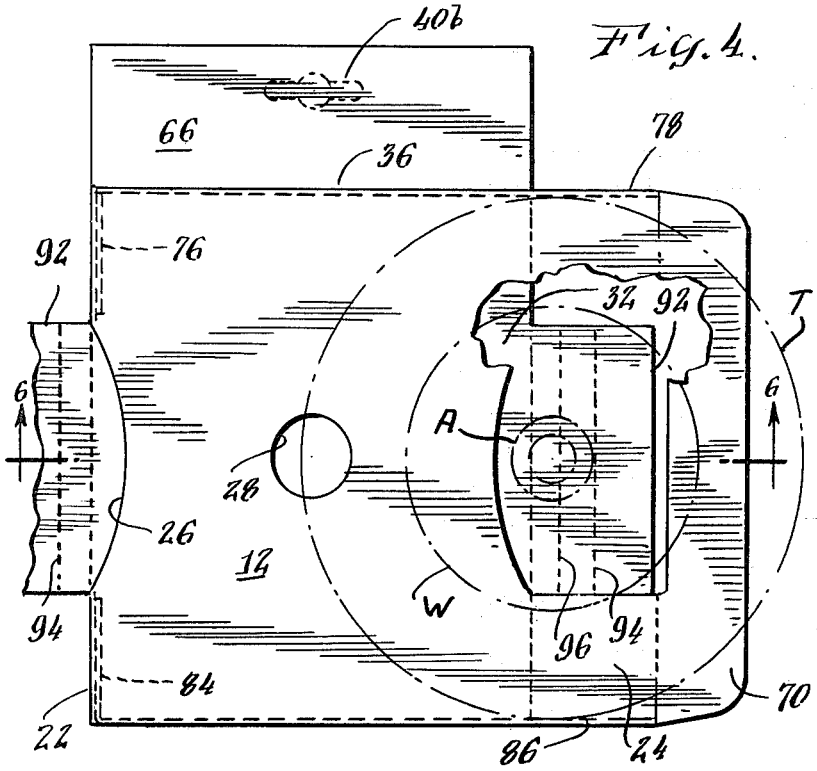
Fig. 4.
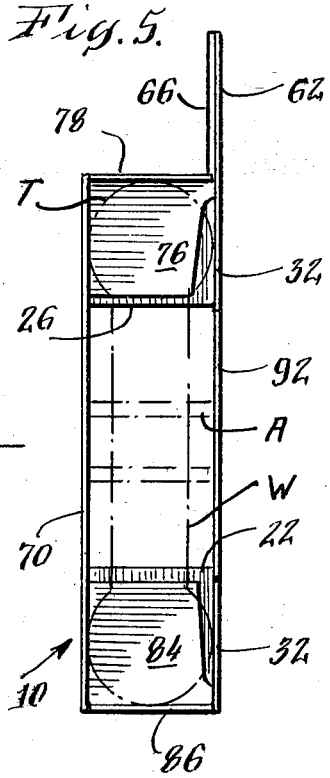
Fig. 5.
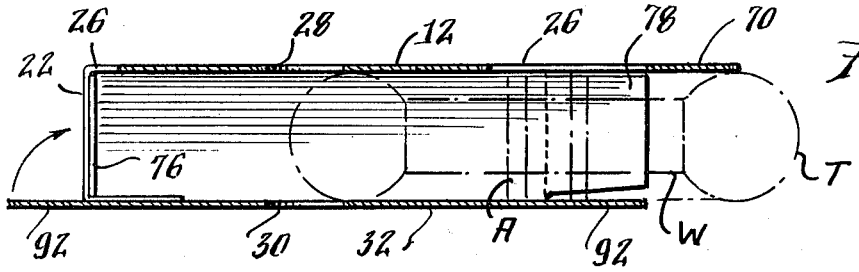
Fig. 6.
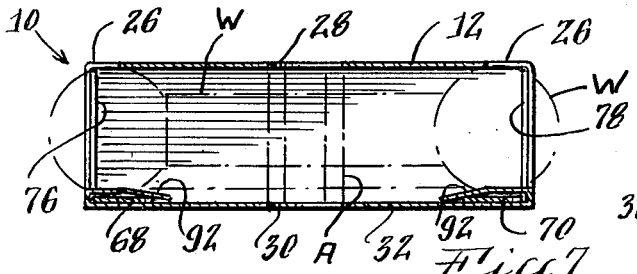
Fig. 7.
Fig. 8.
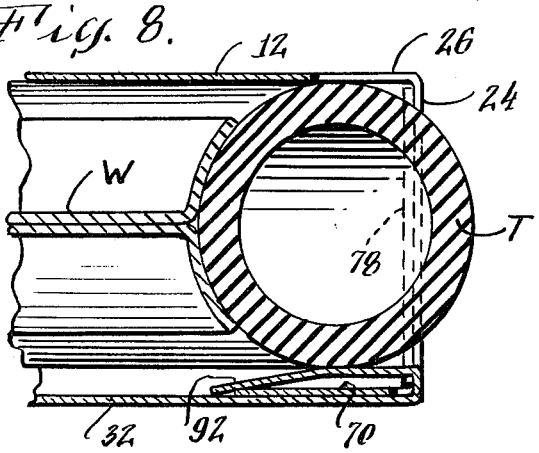
Fig. 9.
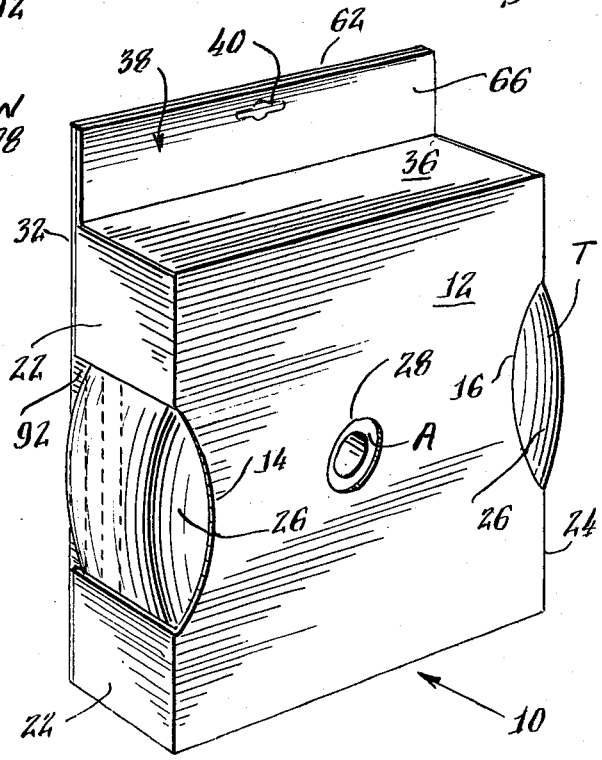

REPLACEMENT WHEEL DISPLAY CARTON

BACKGROUND AND SUMMARY OF THE INVENTION

This invention relates to a carton construction, and more particularly, a theft-proof carton construction used to house and display a replacement wheel assembly.

As with automobile tires, wheel assemblies for garden vehicles or implements such as lawn mowers, wheelbarrows, spreaders and the like come in all sizes and tread designs dependent on the use and terrain on which the garden vehicle will be used. Heretofore, it has been common to market such replacement wheel assemblies either in fully enclosed packages or cartons or loosely in a hardware store or repair shop. Of course, decided advantages are obtained by marketing such replacement wheel assemblies in a carton or package. The size of the wheel assembly can be prominently displayed along with instructions on how to replace the wheel assembly. However, it would also be desirable when marketing such a replacement wheel assembly in a carton or package to display the tire tread design and hub assembly through windows in the carton or package so that a purchaser could select the correct wheel assembly for optimum use dependent on the garden vehicle or implement with which it will be used and the terrain to be traversed by that vehicle.

Accordingly, this invention relates to a carton for a replacement wheel assembly wherein portions of the diameter of the tire on the wheel assembly protrude beyond the carton sides so that the tread on the tire can be readily inspected prior to purchase. The carton is provided with an opposed pair of sidewall panels which contain cutouts so that the tire can protrude beyond the carton sides enabling a purchaser to view and feel the wheel tire prior to selecting the wheel assembly for purchase. Each sidewall panel has a tuck end panel inserted into the carton and secured in place by a tuck lock flap pivotably connected to the rear wall panel of the carton. The tuck lock flap includes a plurality of creases intermediate its side edges so that it can be folded and positioned between the wheel assembly and a tuck end panel within the carton adjacent to the rear wall panel of the carton, between the rear wall panel and the wheel assembly. This precludes unauthorized opening of the carton and removal of the wheel assembly while on display.

The tuck lock flaps can also serve as a cushion for the wheel assembly as they urge and clamp it between the front wall panel and the tuck lock flaps. A central opening in the front and rear wall panels are aligned to receive the wheel axle and to enable the wheel hub, axle and wheel bearing assemblies to also be viewed prior to purchase.

BRIEF DESCRIPTION OF THE DRAWINGS

Further objects and advantages of the invention will become appparent from the following description and claims, and from the accompanying drawings, wherein:

FIG. 4 is a front elevational view of a partially formed carton construction according to the present invention further illustrating the insertion of a wheel assembly into the carton;

FIG. 5 is a side elevational view of the carton construction of FIG. 4;

FIG. 6 is a cross-sectional view taken substantially along the plane indicated by line 6—6 of FIG. 4;

FIG. 7 is a view similar to FIG. 6 but with the tuck lock flaps of the carton in place to prevent removal of the tuck end panels and opening of the carton construction;

FIG. 8 is an enlarged view of the right hand side of FIG. 7; and

FIG. 9 is a perspective view of the carton construction of the present invention.

DETAILED DESCRIPTION OF THE PREFERRED EMBODIMENT

Figure 1:
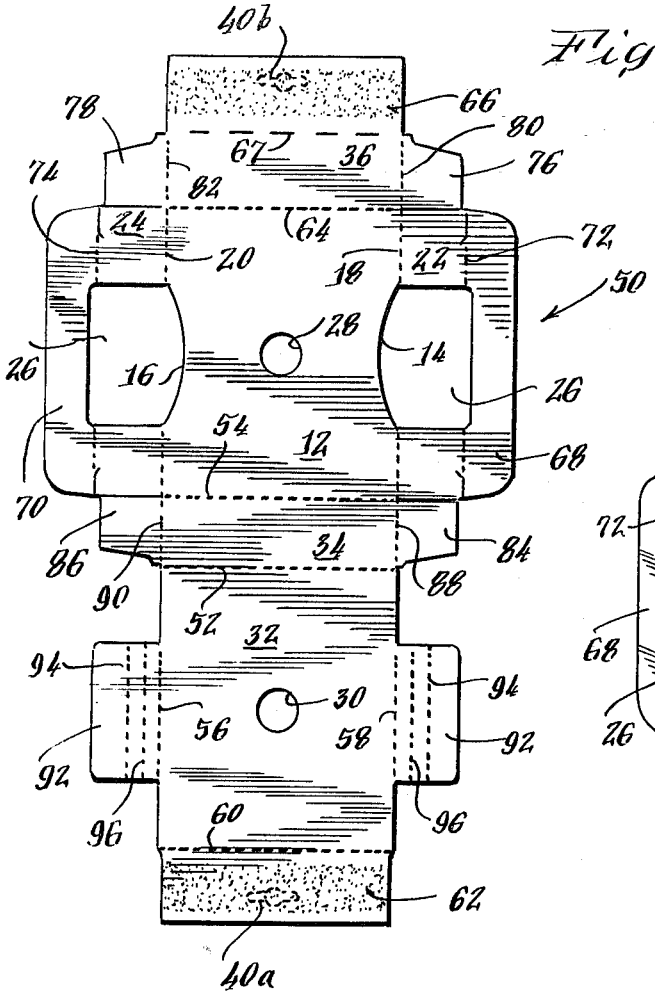
FIG. 1 is a plan view of a blank for forming the carton construction of the present invention.

Referring now to the drawings in detail, wherein like numerals indicate like elements throughout the several views, the carton 10 of the present invention is used to house and display a wheel assembly W provided with a rubber tire T in such a manner that both the hub of the wheel W and tread of the tire T are visible to a prospective purchaser.

Carton 10 includes a front wall panel 12 having arcuate portions 14 and 16 cut from opposed side edges 18 and 20, respectively. Foldably connected to the front wall panel 12 and having a tuck end panel inserted into the interior of the carton 10 adjacent a rear wall panel 32 are a pair of sidewall panels 22 and 24, each of which has a centrally located opening 26. Front wall panel 12 includes a centrally located opening 28 in registration with a similar centrally located opening 30 in a rear wall panel 32. Rear wall panel 32 is connected to the front wall panel 12 by a bottom wall panel 34 and a top wall panel 36. Connected to top wall panel 36 of carton 10 is a hanger flap construction 38 adapted to be provided with a suitable opening 40 so that the carton 10 housing the vehicle wheel assembly W can be hung from a suitable display device such as a hook on a pegboard.

By virtue of the arcuate cutouts 14 and 16 contiguous to openings 26 in each of the sidewall panels 22 and 24, respectively, the tread on tire T can extend outwardly from opposite sides of the carton 10 so that the tread type can be examined by a prospective purchaser prior to purchase. The arcuate cutouts 14 and 16 in the front wall panel 12 permit portions of the wheel assemblies W to be viewed as well as the sides of the tire T, while registered openings 28 and 30 surround the axle A of the wheel assembly W to position the wheel assembly W within the carton 10 and also to permit the axle A and wheel bearings to be viewed.

The carton 10 is formed from a unitary, planar paperboard blank 50 illustrated in FIG. 1.

The blank 50 includes the substantially rectangular front wall panel 12 provided with arcuate cutouts 14 and 16 along the opposed edges 18 and 20, respectively. Opening 28 is centrally located on panel 12. The rear wall panel 32 is foldably connected by a score line 52 to the bottom wall panel 34. The bottom wall panel 34 is foldably connected by a score line 54 to the bottom edge of front wall panel 12. Rear wall panel 32 is commensurate in overall dimensions with front wall panel 12 except that its opposed edges 56 and 58 are linear throughout their length.

Connected to the bottom edge of rear wall panel 32 by a score line 60 is a first hanger panel 62 which is substantially rectangular in plan and includes an elongated, centrally located opening 40*a*. Rectangular top panel 36 is foldably connected by a score line 64 to the top edge of front wall panel 12. A second hanger panel 66 is connected by a score line 67 to the top edge of top wall panel 36. An elongated centrally located opening 40*b* is provided in second hanger flap 66.

Side wall panels 22 and 24 are connected along score lines to opposite edges 18 and 20 of front wall panel 12, respectively, and contain the centrally located openings 26. A tuck end flap 68 and 70 is foldably connected along a score line 72 and 74, respectively, to the outer edge of each of the sidewall panels 22 and 24, respectively. Tuck flaps 76 and 78 are foldably connected to the opposite side edges 80 and 82, respectively, of top wall panel 36. Similarly, tuck flaps 84 and 86 are foldably connected by score lines 88 and 90, respectively, to opposite side edges of the bottom wall panel 34. A tuck lock flap 92 is also foldably connected to each of the opposite edges 56 and 58 of rear wall panel 32 and extends outwardly therefrom at essentially the midpoint of the respective side edge 56 or 58. Each of the tuck lock flaps 92 includes a pair of longitudinal fold or crease lines 94 and 96 parallel to each other and the edge 56 or 58.

The blank 50 is folded into carton 10 as illustrated in FIGS. 2 to 7, inclusive.

Figure 3:
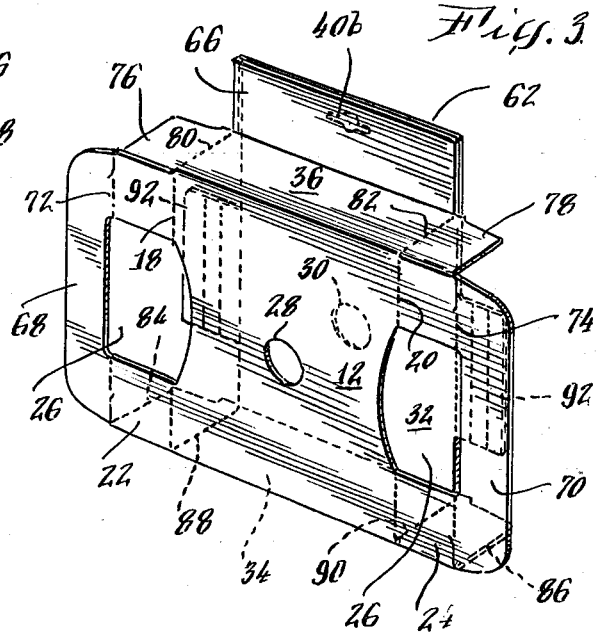
FIGS. 2 and 3 are perspective views of the blank of FIG. 1 folded in successive steps to form the carton construction of the present invention.
Figure 2:
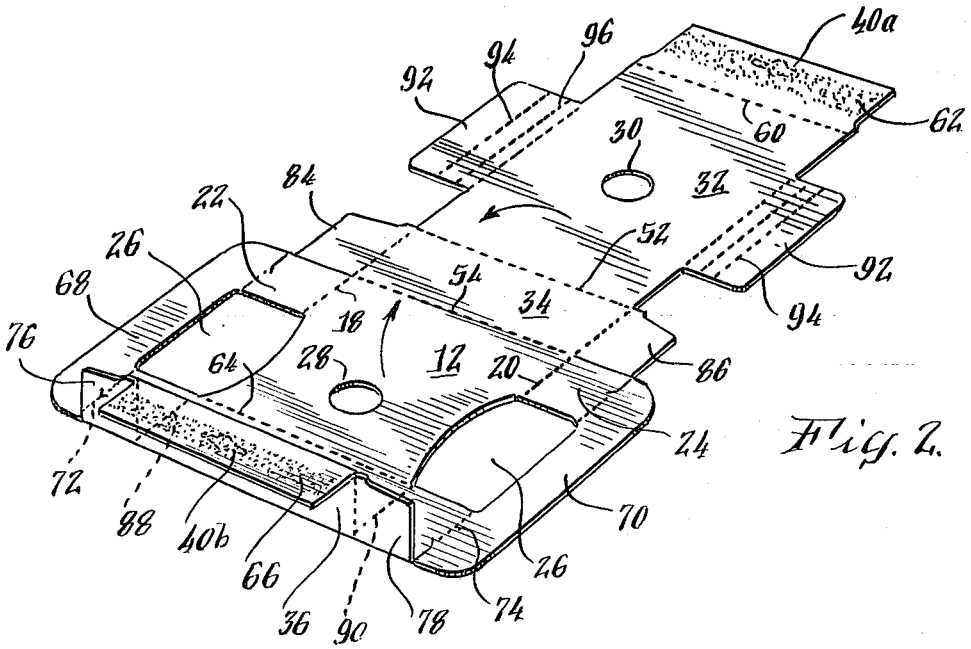

As shown in FIGS. 2 and 3, the front and rear wall panels 12 and 32, respectively, are first folded about the score lines 54 and 52, respectively, into parallel relationship to each other and 90 degrees relative to the bottom wall panel 34. Top wall panel 36 is then folded 90 degrees relative to front and rear wall panels 12 and 14. Second hanger panel 66 is folded 90 degrees relative to the top wall panel 36 and placed in abutment with the first hanger panel 62 extending upwardly from the top of the rear wall panel 32. Openings 40*a* and 40*b* will be placed in registration to form an opening for receiving a hook or the like to hang the carton 10 on a suitable display rack. If desired, the openings 40*a*, 40*b* can be closed by a punchout tab connected to the first and second hanger panels by serrated lines of weakness.

With the carton 10 in the configuration described above and illustrated in FIGS. 3–6, the wheel assembly W and tire T can be disposed through either side into the interior of carton 10 between the parallel front and rear panels 12 and 32 and the ends of axle A disposed between registered openings 28 and 30. Top tuck flaps 76 and 78 can then be folded about score lines 80 and 82, respectively, to overlie each of the sides of carton 10. Similarly, bottom tuck flaps 84 and 86 can be folded 90 degrees about score lines 88 and 90 to overlie the sides of carton 10.

The sidewall panels 22 and 24 can then be folded relative to side edges 18 and 20 of front panel 12 until the tire T on wheel assembly W extends through each of the openings 26. Tuck end panels 68 and 70 are then folded 90 degrees about score lines 72 and 74, respectively, relative to side wall panels 22 and 24, respectively, and inserted into carton 10 between the wheel assembly W and rear wall panel 32 adjacent to the edges 56 and 58 of rear wall panel 32 to form a rectangular paralellopiped carton 10 to house and display wheel assembly W and tire T within the interior of carton 10.

In order to preclude inadvertent or unauthorized opening of the sidewall panels 22 and 24 so as to remove the wheel assembly W while on display, each of the tuck lock flaps 92 are folded 180 degrees or rolled about one of the longitudinal score crease lines 94, 96 and placed between the wheel assembly W and one of the tuck end panels 68, 70 within the interior of carton 10 through an adjacent opening 26, as shown in FIGS. 7 and 8. When a tuck lock flap 92 overlies tuck end panel 68 and 70 within the interior of carton 10, the tuck end flap cannot be removed from the interior of carton 10 to enable removal of wheel assembly W.

Depending upon the overall width of the wheel assembly W, the tuck lock flap 92 will be folded about either score line 94 or 96. The tuck lock flaps 92 will also serve as a cushion or shock absorber precluding undue movement of wheel assembly W and tire T within the interior or carton 10 as the resilience of each tuck lock flap 92 will push the wheel assembly W and tire T towards the front wall panel 12 of the carton 10. Because of the openings 26 and 28, the wheel bearings, hub and axle of wheel assembly W, can also be inspected by a prospective customer without removing the wheel assembly from carton 10.

What is claimed as new is:

1. A carton construction comprising:

a front wall panel, a rear wall panel, a top and bottom wall panel connecting said front and rear wall panels, and a first and second sidewall panel connected to opposite side edges, respectively, of said fron wall panel, a centrally located opening in each of said first and second sidewall panels permitting the display of an article housed within said carton construction, each of said sidewall panels also including a tuck end panel received within the interior of said carton adjacent to said rear wall panel to retain said article within the interior of said carton construction, and a tuck lock flap foldably connected to opposite edges of said rear wall panel insertable into the interior of said carton construction through the opening in each of said first and second side walls to overlie one of said tuck end panels to preclude removal thereof fron the interior of said carton construction.

2. The carton construction of claim 1 wherein said tuck lock flaps each include a plurality of longitudinal fold lines traversing each of said flaps from its top to its bottom edge.

3. The carton construction of claim 1 wherein said front wall panel includes an arcuate cutout along each of its opposite side edges contiguous to the opening in each of said first and second sidewall panels.

4. The carton construction of claim 1 wherein said front and rear wall panels include a centrally located opening in registration with each other.

5. The carton construction of claim 1 including a hanger panel having a first panel portion foldably connected to one of the edges of said top wall panel and an abutted and adhered second hanger panel portion extending upwardly from the top edge of said rear wall panel.

6. A unitary paperboard blank for forming the carton construction of claim 1.

7. A unitary paperboard blank for forming the carton construction of claim 2.

8. A unitary paperboard blank for forming the carton construction of claim 3.

9. A unitary paperboard blank for forming the carton construction of claim 4.

10. A unitary paperboard blank for forming the carton construction of claim 5.

11. A paperboard blank for forming a display carton comprising:

a first substantially rectangular panel having centrally located arcuate cutouts extending along opposite side edges thereof, a second rectangular panel foldably connected to the bottom edge of said first rectangular panel, a third rectangular panel foldably connected to an edge of said second rectangular panel, said third rectangular panel including linear side edges and being of the same overall dimensions as said first rectangular panel, a fourth rectangular panel foldably connected to the top edge of said first rectangular panel, a first side panel foldably connected to the opposite side edges of said first rectangular panel, each of said side panels having a centrally located opening formed therein, a second side panel foldably connected to each of said first side panels, and a third side panel extending from the central portion of each of the side edges of said third rectangular panel, each of said third side panels including at least one longitudinal fold line extending from its top to bottom edge.

12. A blank in accordance with claim 11 wherein said first and third rectangular panels include centrally located circular openings.

13. A blank in accordance with claim 11 including a fifth rectangular panel foldably connected to the bottom edge of said third rectangular panel, and a sixth rectangular panel foldably connected to the top edge of said fourth rectangular panel.

* * * * *